United States Patent [19]

Niemeier

[11] 4,222,359

[45] Sep. 16, 1980

[54] INJECTION PUMP, ESPECIALLY FOR MOTOR VEHICLES

[75] Inventor: Gerd Niemeier, Stuttgart, Fed. Rep. of Germany

[73] Assignee: Daimler-Benz Aktiengesellschaft, Fed. Rep. of Germany

[21] Appl. No.: 923,546

[22] Filed: Jul. 11, 1978

[30] Foreign Application Priority Data

Jul. 14, 1977 [DE] Fed. Rep. of Germany ..... 2731912

[51] Int. Cl.[3] ..... F02D 1/06

[52] U.S. Cl. ..... 123/366; 123/179 G; 123/198 D; 123/382

[58] Field of Search ..... 123/140 MC, 140 MP, 123/140 FG, 32 J, 32 EG, 179 L, 179 G, 179 BG, 139 AZ, 198 DB, 198 D, DIG. 11

[56] References Cited

U.S. PATENT DOCUMENTS

| | | | |
|---|---|---|---|
| 2,161,743 | 6/1939 | Heinrich et al. | 123/140 MC |
| 2,865,356 | 12/1958 | Groezinger | 123/140 MC |
| 3,107,483 | 10/1963 | Hamilton | 123/140 MC |
| 3,128,751 | 4/1964 | Dahl et al. | 123/140 MC |
| 3,664,319 | 5/1972 | Channing | 123/179 L |
| 4,095,573 | 6/1978 | Kollmann | 123/140 MP |

*Primary Examiner*—Ira S. Lararus
*Assistant Examiner*—Magdalen Moy
*Attorney, Agent, or Firm*—Craig & Antonelli

[57] ABSTRACT

An injection pump, especially for motor vehicles with a control rack and a centrifugal governor, in which the control rack is adjustable by way of a first vacuum box in dependence on the ignition key position and in which, in the stop position of the ignition key, vacuum is applied to the first vacuum box and the control rack is transferred into its turn-off position; a second temperature-dependent vacuum box adapted to be connected with vacuum is provided, whereby an end position corresponding to the full load position is adapted to be determined for the control rack by way of this second vacuum box above a predetermined engine limit temperature.

9 Claims, 2 Drawing Figures

INJECTION PUMP, ESPECIALLY FOR MOTOR VEHICLES

Figure 1:
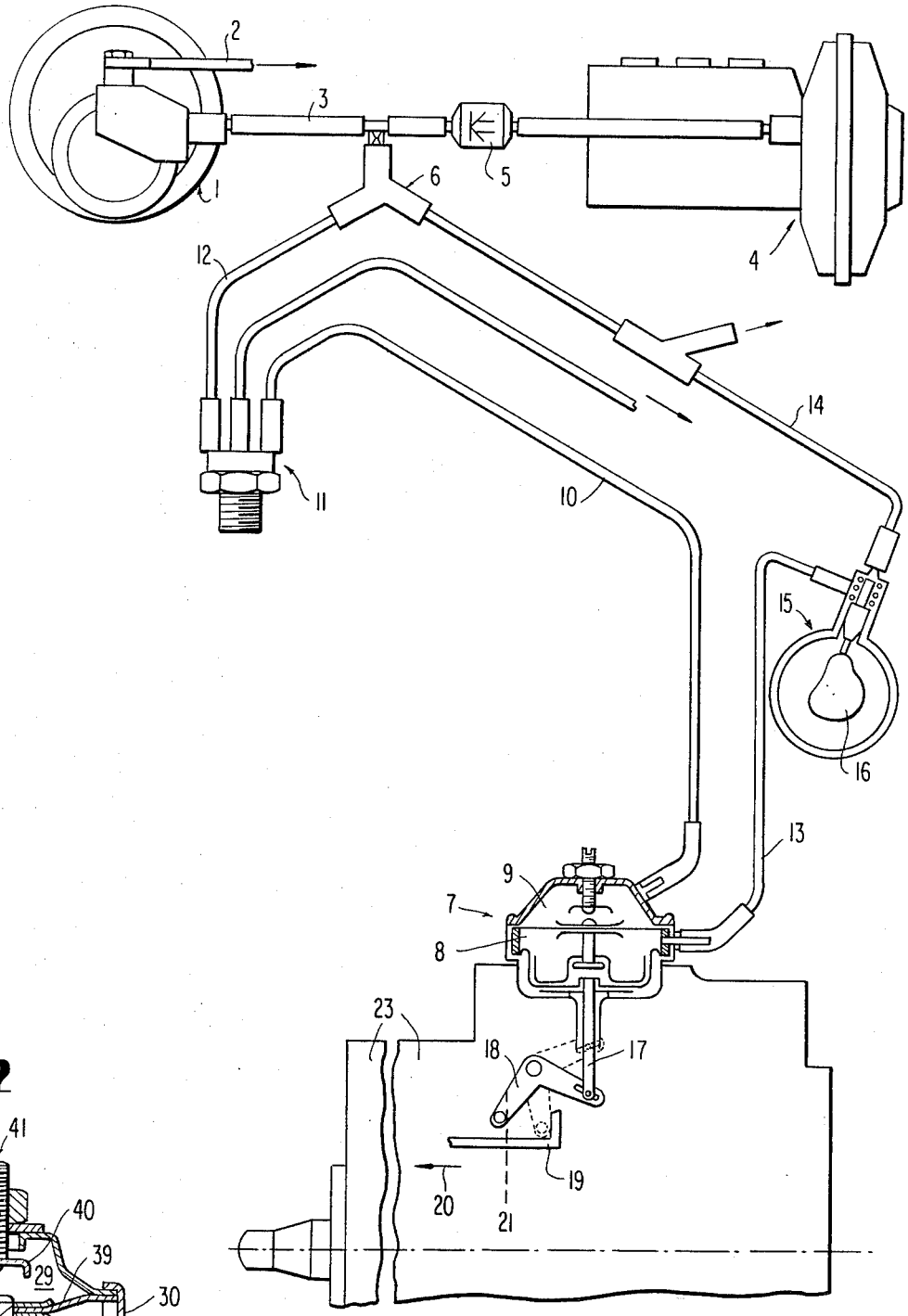

The present invention relates to an injection pump, especially for motor vehicles with a control rack and a centrifugal governor, in which the control rack is adjustable by way of a vacuum box in dependence on the ignition key position and in which, in the stop position of the ignition key, vacuum is applied to the vacuum box and the control rack is transferred into its turn-off position by way of the vacuum box connected to vacuum.

Injection pumps of the aforementioned type include a control mechanism by way of which an idling position, a full-load position as well as starting position are adjustable in dependence on the centrifugal governor and the control linkage connected in series therewith by way of a control lever, whereby in the starting position the control rack is displaced beyond its full load point and an increased quantity of fuel is injected compared to the full load quantity. This increased quantity is meaningful only when starting is undertaken with a cold engine and should also be injected especially only for the starting operation, properly speaking, if it should not lead to an undesired soot formation.

With the prior art constructions, this is not always assured and accordingly a solution is to be provided according to the present invention, with which these shortcomings can be avoided.

According to the present invention, this is achieved in that a second temperature-dependent pressure box adapted to be connected with vacuum is provided and in that an upper control rack end position corresponding to the full-load position is adapted to be determined for the control rack above an engine limit temperature by way of this second pressure box. As a result of this construction, the injection of an increased quantity which exceeds the full load quantity is precluded in every case, if the engine temperature has exceeded an upper limit temperature of, for example, 10° C. or 20° C., whereby in view of the fact that an already present energy source is utilized, the constructive and spaced expenditures are relatively slight and whereby in particular in respect of the temperature-dependent additional connection of the vacuum to the second pressure box, also tested and proved elements, for example, thermal valves may be resorted to, which can be screwed from the cylinder head or can be connected to the cooling circulation in any other known manner.

It is appropriate in realization of the present invention if the first and the second pressure box are combined into a structural unit with separate vacuum connections, whereby the partition wall between the first and second pressure box is preferably formed by the diaphragm of the second pressure box.

Accordingly, it is an object of the present invention to provide an injection pump, especially for motor vehicles, which avoids by simple means the aforementioned shortcomings and drawbacks encountered in the prior art.

Another object of the present invention resides in an injection pump system in which soot formation is effectively precluded even when starting the engine.

A further object of the present invention resides in a control mechanism for injection pumps of motor vehicles which is simple in construction, utilizes relatively few, inexpensive parts and is highly reliable in operation under all engine conditions to avoid soot formation.

A still further object of the present invention resides in a control mechanism for injection pumps of motor vehicles in which an injection of an increased quantity exceeding the full-load quantity is precluded when the engine temperature has exceeded an upper limit temperature.

Still another object of the present invention resides in a control mechanism for injection pumps of motor vehicles which offers the advantage of relatively low expenditures for its construction and space requirements and which permits the use of tested and previously accepted elements.

Figure 2:
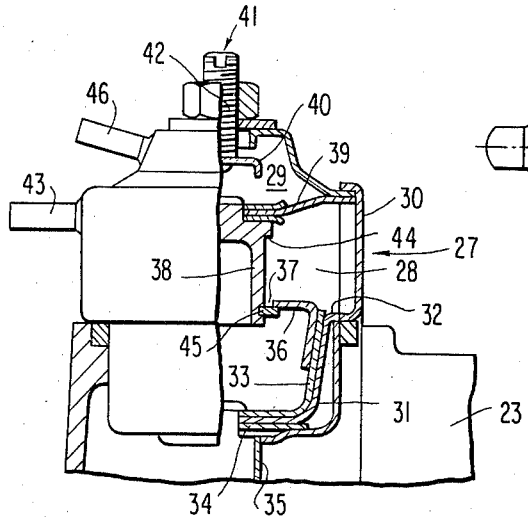

These and other objects, features and advantages of the present invention will become more apparent from the following description when taken in connection with the accompanying drawing which shows, for purposes of illustration only, one embodiment in accordance with the present invention, and wherein:

FIG. 1 is a schematic view of an injection pump control installation in accordance with the present invention; and FIG. 2 is an elevational view, partly in cross section, on an enlarged scale, of a preferred embodiment of a pressure box structural unit in accordance with the present invention, which includes a first and second pressure box, whereby the two pressure boxes act on a common adjusting member.

Referring now to the drawing and more particularly to the schematic showing according to FIG. 1, a vacuum pump is generally designated therein by reference numeral 1 which at 2 includes a connection to the suction pipe of the engine, not illustrated in detail, and from which a line 3 leads to a schematically illustrated brake-force booster generally designated by reference numeral 4. A check valve 5 which opens in the direction toward the brake-force booster 4 is connected in the line 3 while the branching-off generally designated by reference numeral 6 is provided ahead of this check valve 5, i.e., between the check valve 5 and the vacuum pump 1, by way of which of which other vacuum loads can be supplied with vacuum. Within the scope of the solution according to the present invention, among these other vacuum loads is a vacuum-box structural unit generally designated by reference numeral 7 which includes a first vacuum box 8 and a second vacuum box 9, to which a separate connection each is coordinated. The connection for the vacuum box 9 includes a line 10 which is connected with the bifurcation 6 by way of a thermo-valve of conventional construction generally designated by reference numeral 11 and arranged, in the cylinder head and by way of a further line 12. The themo-valve 11 opens up the connection of the vacuum box 9 with the vacuum pump 1 as vacuum source, as soon as a predetermined upper boundary temperature of preferably 10° C. or more has been exceeded on the engine side, as detected by the thermo-valve 11.

The first vacuum box 8 is connected to the vacuum dependence on the ignition key position, whereby the line connection 13, 14 provided therefor extends by way of a valve, generally designated by reference numeral 15, which is actuatable by way of a control cam 16 in dependence on the position of the ignition key (not shown). If the ignition key assumes its starting or driving position, then the connection to the vacuum source, i.e. to the vacuum pump, is closed off by way of the control cam 16 and the first vacuum box 8 is vented, i.e.

is in communication with the atmosphere. If, in contrast thereto, the ignition key is transferred into its stop position, then the control cam 16 assumes a position in which the valve 15 connects the lines 13 and 14 and as a result thereof connects the first vacuum box 8 with the vacuum source in a manner not illustrated herein.

The connection of the first vacuum box 8 as also of the second vacuum box 9, however, has as a consequence, in relation to the shown illustration, a lifting of the adjusting rod 17 which causes a pivoting of the bell crank 18. The latter, with a vacuum connection of both the first as also the second vacuum box, limits the adjusting path or travel of the control rack indicated in FIG. 1 by reference numeral 19, whereby, with a connection of the second vacuum box 9 to the vacuum, the adjusting path or travel of the control rack 19 in the direction toward an increase of the injection quantity, i.e. in the direction of arrow 20 is limited to an end magnitude which corresponds to the full load injection quantity so that an increased quantity injection is precluded beyond that achieved when the rack 19 reaches the position shown in FIG. 1.

If, during the rotation of the ignition key to stop position and a corresponding rotation of the control cam 16, the first vacuum box 8 is connected with the vacuum by way of the line connection 13, 14 and the valve 15, then corresponding to the larger adjusting path or travel predetermined for the first vacuum box 8, the bell crank 18 is pivoted into a second position, such as represented by dashed lines in FIG. 1 of the drawing, in which the control rack 19 is so far displaced back opposite the direction of the arrow 20 that the fuel supply is interrupted.

If both boxes 8 and 9 are acted upon with vacuum, then, if the partition wall between the boxes is formed by the diaphragm of the second box 9, a certain superimposition of the adjusting paths may come about which, however, is harmless since the design is so selected that a control for a fuel reduction also takes place already, when the vacuum box 8 alone is acted upon with vacuum, and a possible additional adjusting movement in the direction toward a reduction control can either be accepted or can be absorbed by the interconnection of a spring member in the connection to the control rack 19.

FIG. 2 illustrates a possible practical construction of the vacuum box structural unit which is now generally designated by reference numeral 27 and which, as in the illustration according to FIG. 1, is coordinated to the injection pump designated in FIG. 2 by reference numeral 23.

The vacuum-box structural unit 27 includes again a first vacuum box 28 and a second vacuum box 29. Inside of the housing 30 of the structural unit, the cup-shaped downwardly drawn diaphragm part 31 of the first vacuum box 28 is provided in the lower area thereof, which adjoining its elastic connecting area 32 to the housing 30 is provided with support reinforcements 33 which preferably also have a cup shape and on which the downwardly projecting adjusting rod 35 is mounted within the bottom area 34 of the diaphragm part 31. A further cover member 36 is coordinated to the cup-shaped diaphragm member 31, which includes a central aperture 37 that moves along a central guidance 38 arranged in the housing 30. The guidance 38 is coordinated to the essentially flat diaphragm 39 of the second vacuum box 29 arranged above the first vacuum box 28, whose movement in the upward direction is limited by an abutment disk 40. The magnitude of the adjusting path or travel is thereby adjustable by the adjustment of the abutment disk 40 by way of an adjusting mechanism 41 including an adjusting screw 42. If the first lower vacuum box 28 is connected with the vacuum source by way of the connection 43, then the diaphragm member 31 together with the part coordinated thereto is lifted, whereby the cover member 36 slides along the central guidance 38. The adjusting rod 35 which is constructed tubular or pipe-shaped in the illustrated embodiment, is lifted simultaneously with the lifting of the diaphragm member 31, which triggers the consequences described already by reference to FIG. 1.

The adjusting path of the diaphragm member 31 along the guidance 38 is thereby limited both in upward as also in the downward direction by way of abutments, whereby the upper abutment is formed by a collar 44 of the guidance 38 and the lower abutment by a snap-ring 45 or the like coordinated to the guidance 38. This limitation of the travel has as a consequence that in connection with the reinforcement of the diaphragm member 31, the lower pressure box 28, insofar as it is not subjected to vacuum, has a predetermined height and in practice forms a connection between the diaphragm 39 of the upper second pressure box 29 and the adjusting rod 35, which is not adjustable in the longitudinal direction.

If now the upper second vacuum box 29 is acted upon with vacuum by way of the connection 46, then the diaphragm 39 is lifted, and more particularly up to the abutment disk 40. By reason of the length of the vacuum box 28 establishing the connection to the adjusting rod 35, which is predetermined in the pulling direction, the adjusting rod 35 is lifted upwardly an amount which corresponds to the adjusting path of the diaphragm 39. This adjusting path is so dimensioned that only an adjusting path corresponding to the end magnitude 21 (FIG. 1) is released for the control rack.

As can be appreciated from the drawings in conjunction with the foregoing description, the present invention provides an injection pump control system whereby a single vacuum box unit 7, 27 can provide fuel adjustment based upon ignition switch position and engine temperature. More particularly, when the ignition is in an off position the lower vacuum box 8, 28, causes bell crank 18 to execute a large stroke (equal to the distance between abutments 45, 44 on guide 38) which brings rack 19 to its illustrated position cutting off fuel supply. On the other hand, if the engine is at a temperature above a predetermined value (during starting or after a period of operation), the upper vacuum box 9 produces a lesser stroke (equal to the distance between diaphragm 39 and abutment 40) which brings the bell crank 18 to its solid line position with rack 19 being precluded from movement, in a direction of increased fuel, to position 21, while engine operation below the predetermined temperature results in neither vacuum box 8, 28 nor vacuum box 9, 29 being supplied with vacuum, thereby causing the adjusting rod to remain in its lowermost position that shifts the bell crank to a position enabling the control rack 19 to move beyond position 21 in a direction of increased fuel supply (arrow 20).

While I have shown and described only one embodiment in accordance with the present invention, it is understood that the same is not limited thereto but is susceptible of numerous changes and modifications as known to those skilled in the art, and I therefore do not wish to be limited to the details shown and described but intend to cover all such changes and modifications as are encompassed by the scope of the appended claims.

I claim:

1. An injection pump, comprising control rack means, the control rack means being adjustable by way of a first vacuum box means in dependence on the position of an ignition key, and in which in the stop position of the ignition key, vacuum is applied to the first vacuum box means and the control rack is transferred into a turn-off position by way of the first vacuum box means connected with the vacuum, characterized in that a second, temperature-dependent vacuum box means operable to be connected with vacuum is provided, and in that an upper, control-rack end-position corresponding at least approximately to a full-load position is operable to be determined for the control rack means by way of the second vacuum box means above an engine limit temperature.

2. An injection pump according to claim 1, characterized in that the first and the second vacuum box means are combined into a structural unit having separate vacuum connections.

3. An injection pump according to claim 1 or 2, characterized in that a partition wall is provided between the first and second vacuum box means which is formed by a diaphragm of the second vacuum box means.

4. An injection pump according to claim 3, characterized in that a central guide means coordinated to the diaphragm of the second vacuum box means is provided, and in that a cover member coordinated to the diaphragm of the first vacuum box means is guided on said guide means.

5. An injection pump according to claim 4, characterized in that abutment means are provided for the cover member to limit its movement in the upward and downward direction.

6. An injection pump system comprising an injection pump, a control rack means for adjusting the amount of fuel supplied by said injection pump, a first vacuum box means that is responsive to the position of an ignition for transferring said control rack to a fuel-off position when said ignition is in an off position causing vacuum to be communicated with said first vacuum box means, a second vacuum box means, and means for causing vacuum to be communicated with said second vacuum box means when a predetermined engine temperature limit is exceeded, said second vacuum box means being operable for limiting movement of said control rack means, in a direction of increased fuel supply, to a predetermiined full-load position when vacuum is communicated therewith and permitting said control rack means to supply fuel in excess of that supplied in said full-load position when vacuum is not supplied to said second box means.

7. An injection pump system according to claim 6, wherein said first and second vacuum box means comprise separate diaphragms.

8. An injection pump according to claim 7, where said diaphragms are mounted within a common vacuum box housing.

9. An injection pump system according to claim 8, wherein said first and second vacuum box means are operatively connected to an adjusting means for adjusting movement of said control rack means, said first vacuum box means being constructed and arranged to displace said adjusting means by an extent greater than the extent to which it can be displaced by said second vacuum box means.

* * * * *